US005339713A

United States Patent [19]

Hou

[11] Patent Number: 5,339,713

[45] Date of Patent: Aug. 23, 1994

[54] AUTOMATIC SCREW FEED-IN APPARATUS

[76] Inventor: Chih-Hsiang Hou, 4F, No. 4, Lane 46, Chang-An St., Lu-Chou Hsiang, Taipei Hsien, Taiwan

[21] Appl. No.: 56,486

[22] Filed: May 3, 1993

[51] Int. Cl.[5] ..... B25B 23/02

[52] U.S. Cl. ..... 81/434; 227/120

[58] Field of Search ..... 81/434, 435, 57.37; 227/120, 123, 135

[56] References Cited

U.S. PATENT DOCUMENTS

| | | | |
|---|---|---|---|
| 4,428,261 | 1/1984 | Takatsu et al. | 81/434 |
| 5,083,483 | 1/1992 | Takagi | 81/434 |
| 5,138,913 | 8/1992 | Chen | 81/434 |
| 5,167,174 | 12/1992 | Fujiyama et al. | 81/434 |

FOREIGN PATENT DOCUMENTS

| | | |
|---|---|---|
| 0058986 | 9/1982 | European Pat. Off. . |
| 0532819 | 3/1993 | European Pat. Off. . |
| 2541046 | 3/1977 | Fed. Rep. of Germany . |
| 9207847 | 9/1992 | Fed. Rep. of Germany . |

*Primary Examiner*—James G. Smith

*Attorney, Agent, or Firm*—Ostrolenk, Faber, Gerb & Soffen

[57] ABSTRACT

An automatic screw feed-in apparatus comprises a body constituted by a frame with a cover secured thereon, inside which a substantially circular interior space is formed to receive a pair of feeding wheels rotatable about a central axis thereof, which feeding wheels are in detent engagement with a driving wheel which is rotatable about the central axis with a follower pin extending therefrom through an arcuated slot formed on the cover, concentric with the central axis. An inlet and an outlet are provided on the body with a channel connecting therebetween to conduct an elongated strip having screws equally spaced thereon into the interior space of the body by the driving engagement thereof with the feeding wheels so as to move the screws to a ready-to-be-tightened position. A casing which houses the body in a biasing and movable manner relative to the body has a slot comprising an inclined section to partially receive the follower pin therein so that when the casing is moved toward the body, the driving wheel is caused to move the follower pin from the lower dead point to the upper dead point while the feeding wheels remain un-moved and when the casing is released, the follower pin moves from the upper dead point to the lower dead point to drive the driving wheel which in turn moves the feeding wheels by the detent engagement therebetween to advance the screw strip.

7 Claims, 6 Drawing Sheets

AUTOMATIC SCREW FEED-IN APPARATUS

FIELD OF THE INVENTION

The present invention relates to a screw feed-in device and in particular to an automatic screw feed-in apparatus which is capable to continuously bring screws disposed along an elongated flexible strip to a specified position for tightening after each tightening operation.

BACKGROUND OF THE INVENTION

The state-of-art screw feed-in devices currently available in the market generally comprise a handle and driving head. Within the driving head, a guiding channel is provided for escorting the strip on which the screws are equally spaced. Above the guiding channel, a toothed wheel is mounted in such a manner that when the toothed wheel is rotated an angle equal to the pitch thereof, the screw strip will advance a distance equal the spacing between two adjacent screws.

According to the conventional screw feed-in devices, the feed-in toothed wheel is controlled by a post which is received within an arcuated slot and in mechanical engagement with the handle so that when the handle is lowered down, a clutch member mounted on the post engages the counterpart member secured to the toothed wheel and thus causing an angular movement of the toothed wheel as the post is moved within the arcuated slot. In this way, the screw strip is advanced when the handle is operated.

Theoretically, each lowering-down of the handle will advance the screw strip a distance exactly equal to the spacing between two adjacent screws on the strip and one of the screws should be exactly placed at a location where a screw driver can reach to carry out the screw tightening operation.

One of the disadvantages of the conventional screw feed-in apparatus is the complexity in structure of the clutch members used to mechanically connect the post and the toothed wheel. This not only increases the manufacturing cost of the screw feed-in device, but also requires a more sophisticated technique in manufacturing.

Further, in the conventional screw feed-in device, the advance of the screw strip is done by the lowering-down of the handle. Once the handle is not lowered a suitable distance, the strip will not be moved to exactly have the next screw be placed at the position where the screw driver can normally reach and this results in a difficult situation for the screw driver to correctly engage and tighten the screw. Usually, a manual correction is required to move the screw to be in alignment with the screw driver.

It is therefore desirable to provide an automatic screw feed-in apparatus which comprises an automatic screw advancing mechanism to overcome the above-mentioned problems.

SUMMARY OF THE INVENTION

It is therefore the principal object of the present invention to provide an automatic screw feed-in apparatus which comprises a screw advance mechanism capable to automatically and successively bring the screws disposed on a strip to a precise ready-to-be-tightened position after each time the previous screw is tightened.

It is also an object of the present to provide an automatic screw feed-in apparatus wherein a simple-structured screw advance mechanism is used to replace the complicated clutch members conventionally used in advancing the screw in order to cut down the manufacturing cost of the screw feed-in apparatus.

To achieve the above objects, there is provided an automatic screw feed-in apparatus comprising a body constituted by a frame with a cover secured thereon, inside which a substantially circular interior space is formed to receive a pair of feeding wheels rotatable about a central axis thereof, which feeding wheels are in detent engagement with a driving wheel which is rotatable about the central axis with a follower pin extending therefrom through an arcuated slot formed on the cover, concentric with the central axis. An inlet and an outlet are provided on the body with a channel connecting therebetween to conduct an elongated strip having screws equally spaced thereon into the interior space of the body by the driving engagement thereof with the feeding wheels so as to move the screws to a ready-to-be-tightened position. A casing which houses the body in a biasing and movable manner relative to the body has a slot comprising an inclined section to partially receive the follower pin therein so that when the casing is moved toward the body, the driving wheel is caused to move the follower pin from the lower dead point to the upper dead point while the feeding wheels remained un-moved and when the casing is released, the follower pin moves from the upper dead point to the lower dead point to drive the driving wheel which in turn moves the feeding wheels by the detent engagement therebetween to advance the screw strip.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 5:
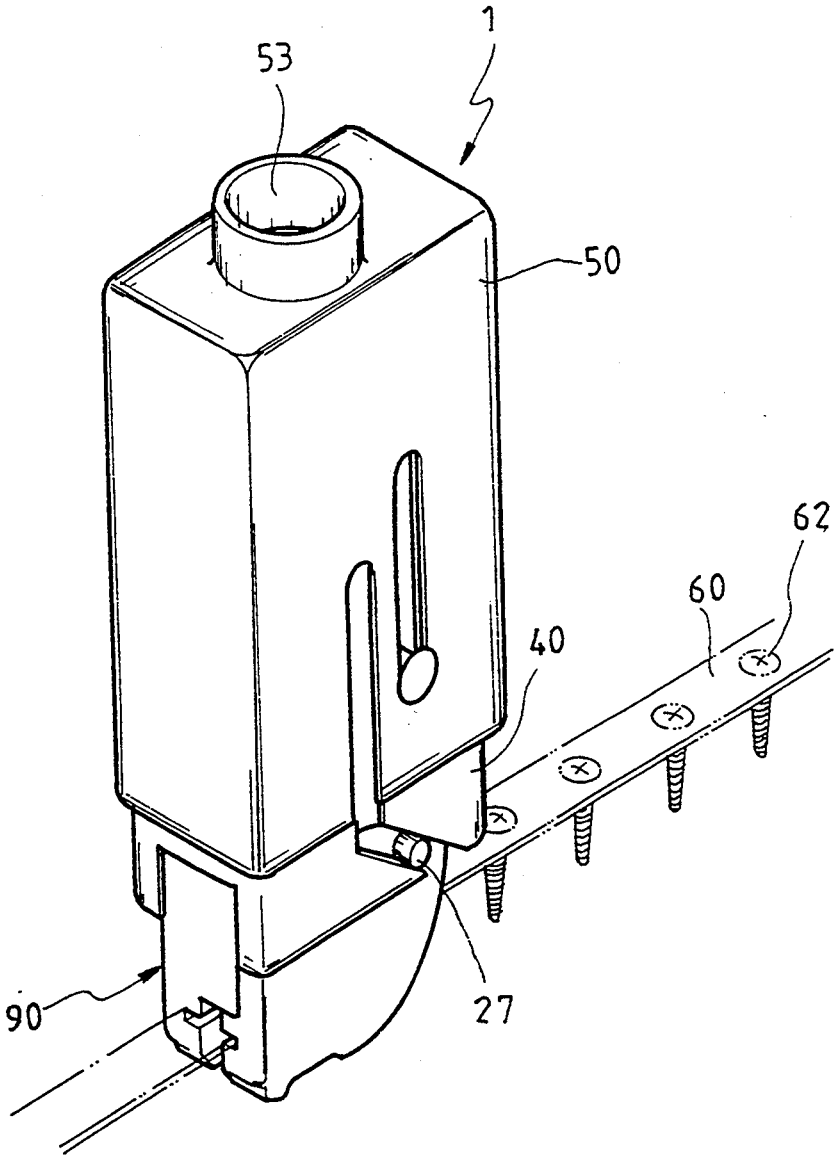
FIG. 5 is a perspective view showing the automatic screw feed-in apparatus of the present invention.
Figure 6:
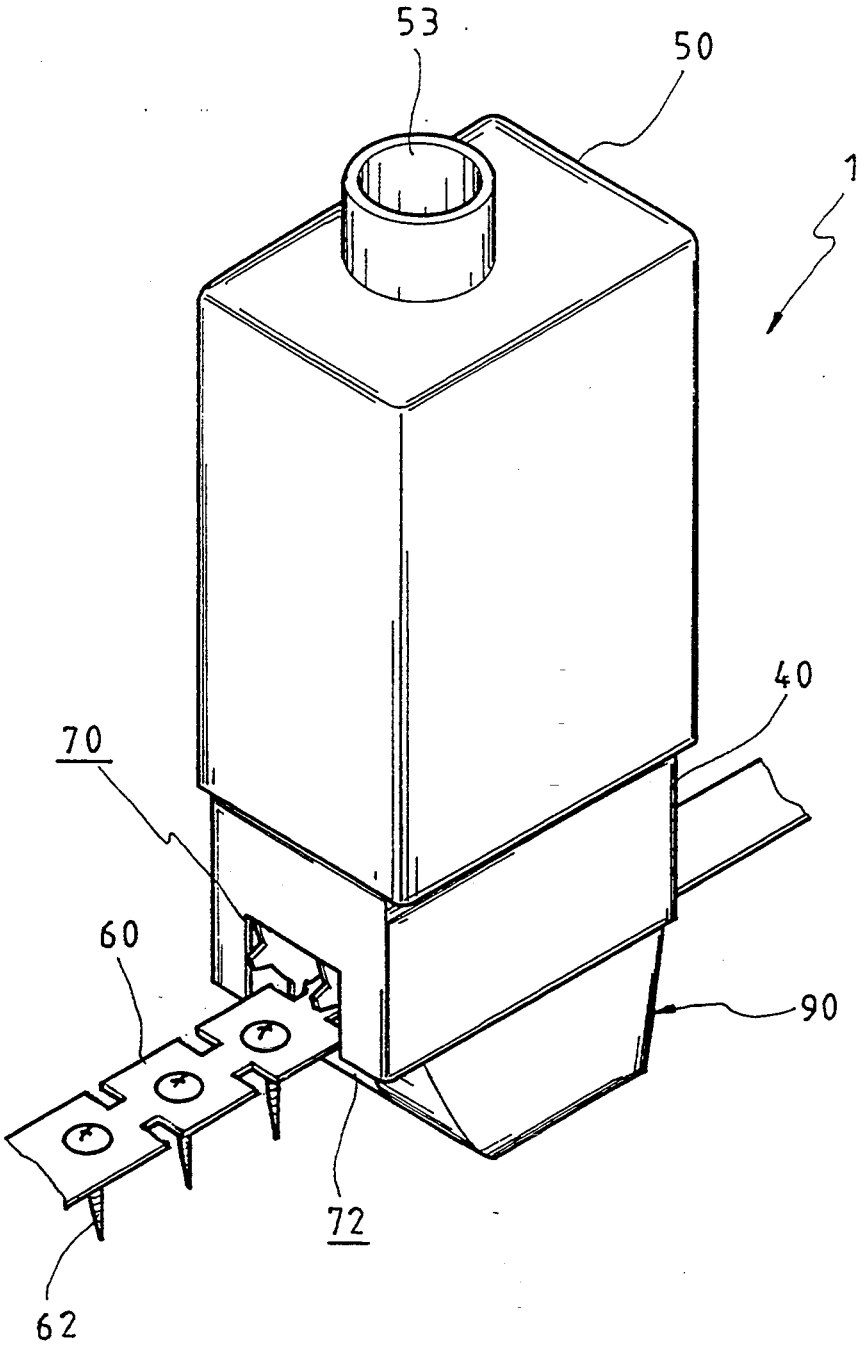
FIG. 6 is also a perspective view of the automatic screw feed-in apparatus of the present invention viewed from a different angle.

With reference to the drawings and in particular to FIGS. 5 and 6, wherein an automatic screw feed-in apparatus constructed in accordance with the present invention, generally designated with the reference numeral 1 is shown, the automatic screw feed-in apparatus 1 provides an automatic feed-in of screws 62 disposed along an elongated flexible strip 60 which is fed into the automatic screw feed-in apparatus 1 so that when the apparatus 1 is in operation, the completion of the tightening cycle of each of the screws 62 will cause the strip 60 to advance such a precise distance to bring the next screw 62 to a ready-to-be-tightened position by the present automatic screw feed-in apparatus 1.

Further refer to FIG. 1, to move the strip 60, a plurality of equally-spaced notches 61 are provided along the two opposite longitudinal sides of the strip 60 which have a similar function as the sprocket holes of a photo film and is engageable with and thus driven by sprocket means or toothed wheels to be described hereinafter. The notches 61 along each longitudinal side of the strip 60 has a distance L between any two successive notches. The notches 61 of the two longitudinal sides of the strip 60 has a lateral distance W inbetween.

The screws 62 are also equally spaced along the strip 60 preferably with a spacing between two successive screws 62 equal to that of the notches 61 along the longitudinal sides thereof. Although in the illustrated embodiment, the spacing between two adjacent screws 62 is equal to the longitudinal distance L between two adjacent side notches 61 of the strip 60, it is not necessary to be so.

Figure 1:
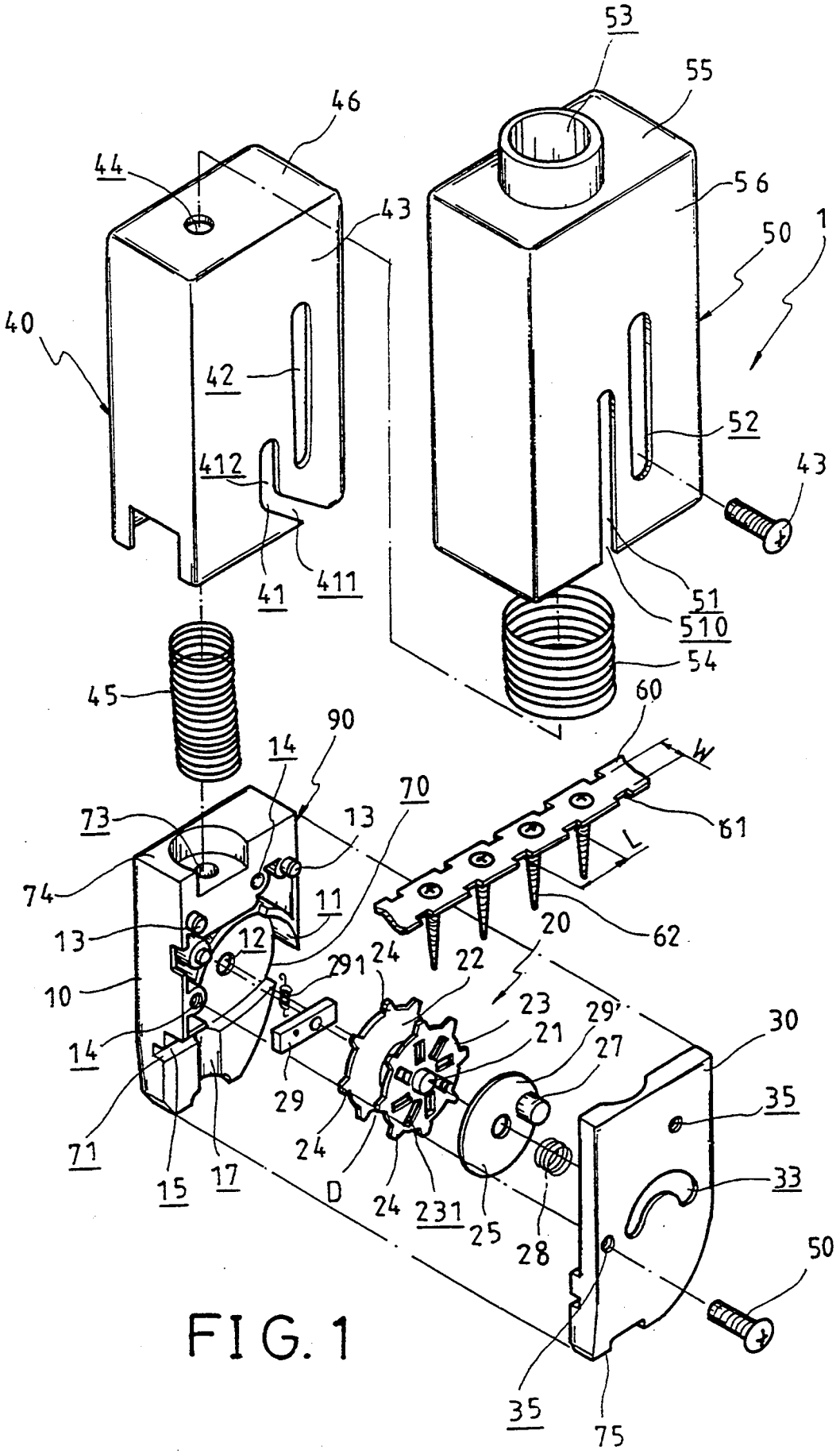
FIG. 1 is an exploded perspective view showing an automatic screw feed-in apparatus constructed in accordance with the present invention.
Figure 2:
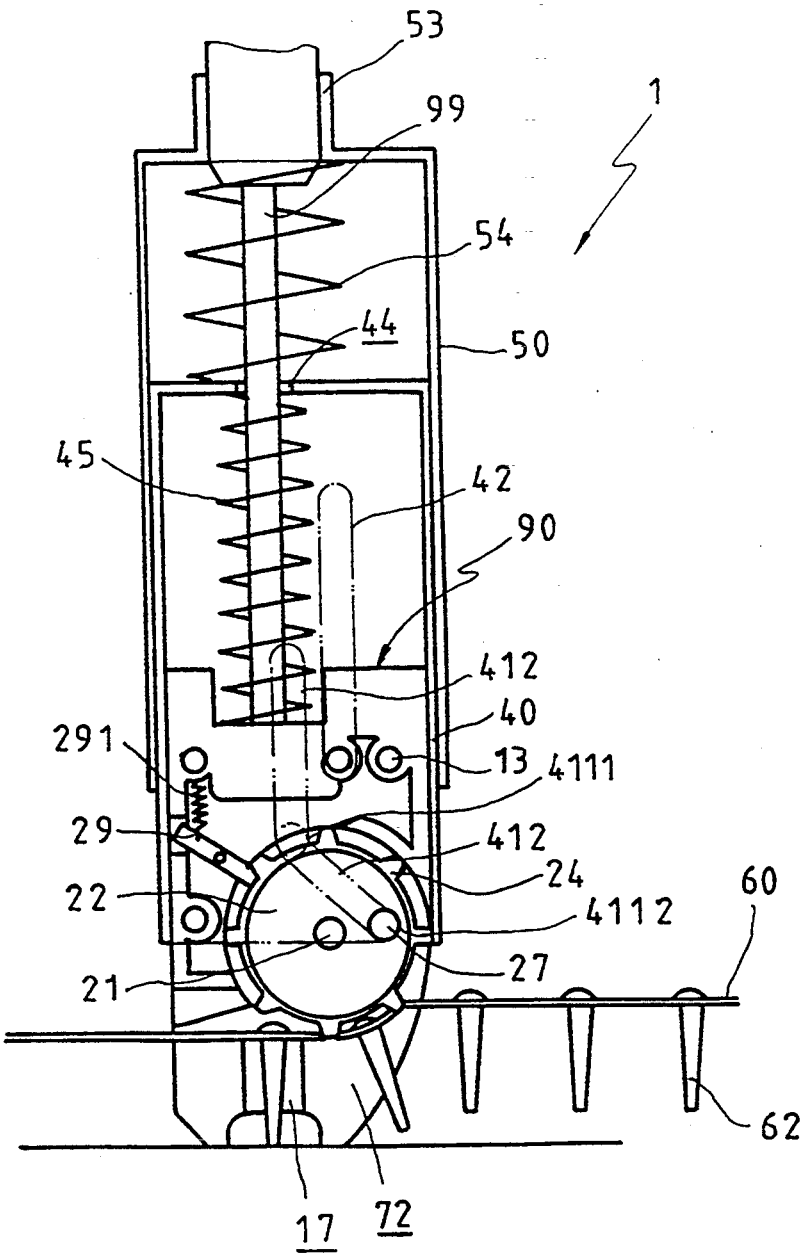
FIG. 2 is a side elevational view of the automatic screw feed-in apparatus of the present invention, with the front wall broken to show the interior structure thereof.
Figure 4:
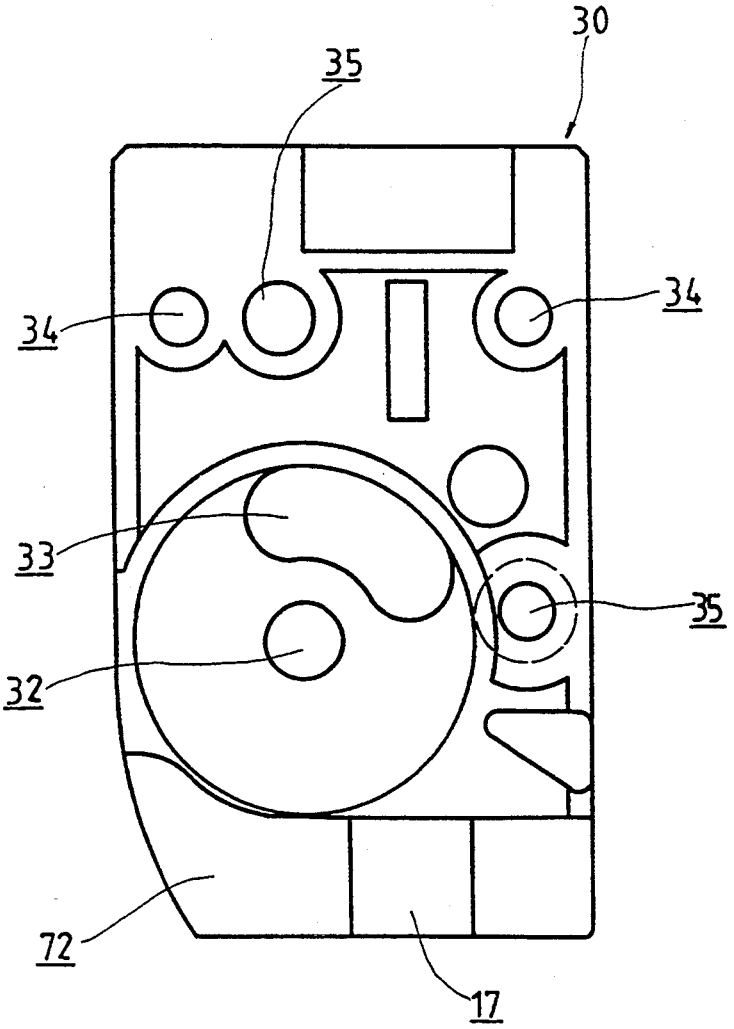
FIG. 4 is a plan view showing the inside structure of the cover of the automatic screw feed-in apparatus of the present invention.

With reference to FIGS. 1 and 2, the automatic screw feed-in apparatus 1 comprises a frame 10 on which a cover 30 is matchingly secured by fastening means to form a substantially rectangular body 90 (also see FIGS. 5 and 6). To facilitate the matching engagement between the frame 10 and the cover 30, a plurality of dowel pins 13, the number of which is two in the illustrated embodiment, are provided on the frame 10 to be insertedly received in corresponding pin holes 34 formed on the cover 30 (see FIG. 4).

The fastening means may comprise a plurality of screws, for example two screws respectively numbered 50 and 43 in FIG. 1, threadingly extending through inner-threaded holes 35 on the cover 30 and tightened to inner-threaded holes 14 on the frame 10. Since the matching and engagement techniques are known to those having ordinary skills, no further detail will be given herein and it is understood that other techniques can also be adapted to achieve the same matching and securing effect.

The body 90 defines therein a circular interior space 11 for receiving therein feeding means 20 which comprises a shaft 21 rotatably supported in journal holes 12 and 32 respectively formed on the frame 10 and the cover 30 and extending along a central axis (not explicitly shown in the drawings) of the circular interior space 11 from the frame 10 to the cover 30. On the shaft 21, a first and a second feeding wheels 22 and 23 are secured in a spaced manner to form a pre-determined spacing D therebetween which is substantially equal to the lateral distance W between the notches 61 of the opposite longitudinal sides of the screw strip 60 so as to allow the strip 60 to pass inbetween the two feeding wheels 22 and 23.

Each of the feeding wheels 22 and 23 has a circular periphery along which a plurality of teeth 24, for example eight, are formed in an angularly equally-spaced manner to have the pitch thereof corresponding to the longitudinal spacing L of the notches 61 of the strip 60 so as to be engageable with the notches 61 and thus capable to move the strip 60 in a forward direction parallel with the length thereof. With this arrangement, once the feeding wheels 22 and 23 are rotated an angle corresponding to the pitch thereof, the strip 60 will be advanced a distance equal to the spacing between two successive screws 62 disposed along the strip 60.

On one surface of one of the feeding wheels 22 and 23, for example the second feeding wheel 23 in the drawings, a plurality of radially-extending slots 231, for example eight in the illustrated embodiment, are angularly equally-spaced. Preferably, each of the slots 231 has a right-angular cross section to serve as detent means to be abuttingly engaged by a detented driving wheel 25 (also see FIG. 3) rotatably mounted on the shaft 21 and thus allowing the feeding wheels 22 and 23 and the shaft 21 to be driven by the rotation of the driving wheel 25.

Figure 3:
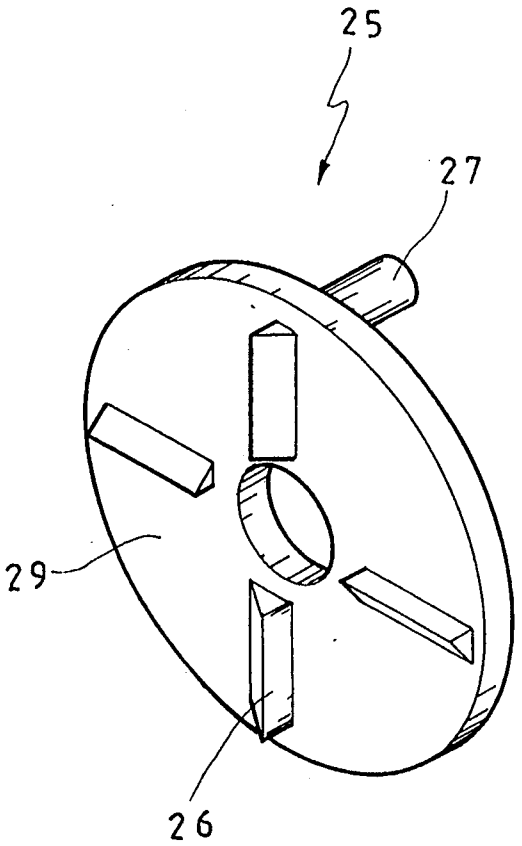
FIG. 3 is a perspective view showing the driving wheel of the automatic screw feed-in apparatus of the present invention.

Further referring to FIG. 3, the driving wheel 25 which is rotatably mounted on the shaft 21 has a plurality of detents 26, for example four as illustrated in FIG. 3, formed on a first surface 29 thereof (see FIG. 3) which faces the second feeding wheel 23 to be received and in abutting engagement with the slots 231 of the second feeding wheel 23.

To achieve the abutting engagement between the slots 231 and the detents 26, each of the detents 26 is formed as an elongated member extending along a direction parallel with a radius of the driving wheel 25, preferably having substantially a right-angular cross section complementary to that of the slots 231 in order to be received within the slots 231.

The detent engagement between the second feeding wheel 23 and the driving wheel 25 allows the driving wheel 25 to drive the second feeding wheel 23 to rotate in unison therewith when the driving wheel 25 is rotated in a first direction which as viewed in FIG. 2 is the clockwise direction. And when the driving wheel 25 is rotated in a second direction opposite to the first direction, the feeding wheels 22 and 23 maintain un-moved.

Biasing means, such as a spring 28, is provided to bias the driving wheel 25 toward and thus forming the abutting engagement with the second feeding wheel 23.

On a second surface 29' of the driving wheel 25, opposite to the first surface 29 thereof, a follower pin 27 is mounted to extend through an arcuated through slot 33 which is formed on the cover 30 concentric with the central axis of the circular interior space 11 and the journal hole 32 formed on the cover 30. The arcuated slot 33 serves as a camming surface as the present automatic screw feed-in apparatus 1 is in operation to drive and guide the follower pin 27 and thus rotating the driving wheel 25.

A paw member 29 is pivotally mounted inside the body 90 to be engageable with the teeth 24 of the feeding wheels 22 and 23, as shown in FIG. 3. The paw member 90 is biased by a resilient means, such as spring 291, so as to allow the feeding wheels 22 and 23 to be only rotatable in one direction and preventing the wheels 22 and 23 from rotating in an opposite direction. This, when cooperating with the detent engagement between the driving wheel 25 and the second feeding wheel 23, the paw member 29 allows the feeding wheels 22 and 23 to only drive the strip 60 to move in a forward direction, not to move in an opposite, backward direction.

The detent engagement between the driving wheel 25 and the second feeding wheel 23 allows the driving wheel 25 to rotate in a first direction which, by the detent engagement therebetween, drive the feeding wheel 23 to rotate in the same direction and thus moving the strip along the forward direction thereof. The detent engagement also allows the driving wheel 25 to be free to independently rotate in a second direction opposite to the first direction, while the feeding wheels 22 and 23 are prevented from moving by the paw member 29, by releasing the detent engagement with the second feeding wheel 23 by having the detents 26 slide out of the slots 231 of the second feeding wheel 23 along the inclined surfaces thereof which constitute part of the triangular cross sections thereof.

A strip inlet 70 and a strip outlet 71 are respectively formed on opposite sides of the body 90 with through channel 15 extending from the inlet 70, across a lowermost portion of the circular interior space 11 formed in the body 10, to the outlet 71 to allow the strip 60 on which the screws 62 to be tightened are disposed to be engaged and thus moved by the feeding wheels 22 and 23 disposed inside the interior space 11 to pass through the channel 15.

The body 90 is also provided, on a portion thereof lower than the interior space 11, with a screw passing slit 72 (see FIGS. 4 and 5) extending from the inlet 70 and a portion of the channel 15 to the outside of the body 90 and having such a width to allow the screws 62 to pass therethrough as the strip 60 is moving through the channel 15. The slit 72 is terminated at an slightly expanded hole 17, which is located at a pre-determined ready-to-be-tightened position, extending from the interior space 11 to a bottom surface 75 of the body 90 to allow the screws 62 to be tightened there.

A screw driving hole 73 is provided on a portion of the body 90 upper than the interior space 11 and extending from a top surface 74 of the body 90 to the interior space 11. The screw driving hole 73 is exactly opposite to the hole 17 so as to constitute a passage for a tool, such as a screw driver 99 (FIG. 2), to insert therethrough to engage with the screw 62 located in the hole 17 and tightening that screw 62.

An inside casing 40 is provided to house the body 90 in such a way that a top wall 46 of the inside casing 40 is located above the top surface 74 of the body 90. A resilient means, such as spring 45, is disposed between the top wall 46 of the inside casing 40 and the top surface 74 of the body 90 to bias the inside casing 40 toward a remote position where the top wall 46 of inside casing 40 is remote from the top surface 74 of the body 90 and allowing the inside casing 40 to move relative to the body 90, against the spring 45, toward a close position where the top wall 46 of the inside casing 40 is close to the top surface 74 of the body 90.

On the top wall 46 of the inside casing 40, a through hole 44 is formed at a location opposite to the screw driving hole 73 formed on the body 90 and having a diameter large enough to allow the screw driver 99 to insert therethrough to enter the screw driving hole 73 of the body 90.

The inside casing 40 comprises a first side wall 43 opposing the cover 30 of the body 90, having formed thereon a driving slot 41 and a guiding slot 42. The driving slot 41 comprises a first, vertical section 412 and a second, inclined section 411 through which second section 412, the follower pin 27 which extends through the arcuated slot 33 of the cover 30 extends and partially projecting out thereof so that when the inside casing 40 is moved from the remote position to the close position, the follower pin 27 is first acted by both the inclined section 411 of the driving slot 41 and the arcuated slot 33 of the cover 30 to move from the lower dead point 4112 thereof to the upper dead point 4111 thereof (see FIG. 2) along the counterclockwise direction as viewed in FIG. 2 and thereafter, further depressing the inside casing 40 will have the follower pin 27 enter the vertical section 412 of the driving slot 41 in which the follower pin 27 is no longer acted upon by the inside casing 40 and will remain at the upper dead point 4111. Further lowering down the inside casing 40 will bring the screw driver 99 close to the screw 62 in the hole 17 to engage with that screw 62.

During the movement of the follower pin 27 from the lower dead point 4112 to the upper dead point 4111, the driving wheel 25 is rotated in a counterclockwise direction as viewed in FIG. 2 while the feeding wheels 22 and 23 are prevented from rotation by the paw member 29.

When the inside casing 40 is released, it is moved from its close position back to its remote position by the biasing spring 45 and thus consequently allowing the follower pin 27 to move from the upper dead point 4111 back to the lower dead point 4112 and, due to the detent engagement between the driving wheel 25 and the second feeding wheel 23, the driving wheel 25 and the feeding wheels 22 and 23 are rotated synchronously, against the biasing force of the spring 291 of the paw member 29, along the clockwise direction as viewed in FIG. 2 to move the strip 60, with the engagement between the teeth 24 of the feeding wheels 22 and 23 and the notches 61 thereof, along its forward direction a distance equal to the spacing between two adjacent screws 62 so as to place the next screw 62 on the ready-to-be-tightened position within the hole 17 of body 90.

The guiding slot 42 is in correspondence with one of the fastening screws which secure the cover 30 to the frame 10, for example screw 43, to allow the screw 43 to partially project out of the guiding slot 42 so as to guide the movement of the inside casing 40 relative to the body 90 and to prevent the inside casing 40 from disengaging from the body 90.

Preferably, an outside casing 50 is provided to encase the inside casing 40 and the body 90 is such a manner that a top wall 55 thereof is located above the top wall 46 of the inside casing 40 and with the arrangement of a resilient means, for example spring 54, between the top wall 46 of the inside casing 40 and the top wall 55 of the outside casing 50, the outside casing 50 is biased toward an upper position where the top wall 55 of the outside casing 50 is remote from the top wall 46 of the inside casing 40 and is allowed to move relative to the inside casing 40, against the spring 54, toward a lower position where the top wall 55 of the outside casing 50 is close to the top wall 46 of the inside casing 40.

The outside casing 50 further has a side wall 56 opposing the side wall 47 of the inside casing 40 and having thereon a first slot 51 extending vertically and overlapping the vertical section 412 of the driving slot 41 formed on the inside casing 40. The first slot 51 has a lower opened end 510 to allow the follower pin 27 to enter therein when the inside casing 40 and outside casing 50 are both moved toward the body 90 to operate the present automatic screw feed-in apparatus 1. A second slot 52 which is substantially corresponding to and overlapping the guiding slot 42 of the inside casing 40 is also formed on the side wall 56 of the outside casing 50 to allow the screw 43 to extend therethrough to guide the movement of the outside casing 50 with respect to the inside casing 40 and the body 90 and to prevent the outside casing 50 from disengaging from the apparatus 1.

A tool connection means, for example a receiving hole 53, is provided on the top wall 55 of the outside casing 50 at a location exactly opposite to the through hole 44 formed on the top wall 46 of the inside casing 40 for engaging a driving tool (not shown) for driving the screws 60.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A screw feed-in apparatus for automatically advancing screws disposed along an elongated strip toward a pre-determined ready-to-be-tightened position to be tightened by a tool, said apparatus comprising:

a body having a frame with a cover secured thereon to define therein a circular interior space which has a central axis extending from said frame to said cover, an inlet formed on a lateral side of said body and an outlet formed on an opposite lateral side with a channel large enough for the screw strip to pass connecting between said inlet and said outlet and partially extending through a lower portion of said circular interior space, said body further having a slit formed at a portion lower than said channel and extending from a portion of said circular interior space to a bottom surface of said body to define a passage for the screws to pass;

screw feeding means disposed within said circular interior space to be drivingly engageable with the screw strip so for advancing the strip in a forward direction along said channel, from said inlet to said outlet; said feeding means comprising a shaft which extends along and is rotatable about the central axis of said circular interior space, a pair of feeding wheels mounted in an axially-spaced manner, on said driving wheel, each of said feeding wheels having a periphery on which a plurality of teeth are formed in an angularly equally-spaced manner to engage with two opposite equally-spacedly notched longitudinal sides of the strip for advancing the strip in the forward direction as the feeding wheels are rotated in a first direction;

driving means in detent engagement with said feeding means so that when said driving means is forced to move from a first position to a second position, said feeding means remains un-moved, and when said driving means moves from the second position to the first position, said feeding means is actuated to make a precise movement to exactly advance one of the screws disposed along the screw strip to the ready-to-be-tightened position;

said driving means comprises a driving wheel rotatably mounted on said shaft and having a plurality of detents formed on one surface said driving wheel facing said feeding wheels, each of said detents comprising an elongated member mounted on said one surface of the driving wheel, extending along a radius of said driving wheel and having a substantially right-triangular cross section for being respectively received within a plurality of radially extending, right-triangular cross-sectional slots formed on a surface of one of said feeding wheels facing said driving wheel to form the detent engagement between said feeding wheels and said driving wheel, said right-triangular cross sections of said detents of said driving wheel and the slots of said feeding wheels comprising an inclined camming surface so that when said driving wheel is rotated from the first position thereof to the second position thereof, said camming surface of each of said detents received within said slots of said feeding wheels slides along said camming surfaces of said slots and thus moving out thereof to have said feeding wheels disengage from said driving wheel so as to maintain un-moved and when said driving wheel is rotated from the second position to the first position, said detents abuttingly engage said slots so as to have said feeding wheels to rotate in unison with said driving wheel;

paw means in engagement with said feeding means to prevent said feeding means from moving in a direction opposite to advancing the screw strip in the forward direction; and actuation means in mechanical engagement with said driving means so that when said actuation means is moved from a rest position to a work position, said driving means is caused to move from the first position to the second position to allow the screw located at the ready-to-be-tightened position to be engaged and tightened by the tool, and when said actuation means is moved from the work position to the rest position, sad driving means is released to move from the second position back to the first position to allow said feeding means to make a precise advance of the screw strip in order to bring the screw which is next to the just-tightened one to the ready-to-be tightened position.

2. An apparatus as claimed in claim 1, wherein said paw means comprises a paw member pivotally mounted inside said body and having one end thereof spring-biased to have an opposite end thereof in contacting engagement with the teeth of said feeding wheels so that said feeding wheel is allowed to rotate in the first direction thereof only and, due to the contacting engagement of said feeding wheels with said paw member, rotation of said feeding wheels in a direction opposite to the first direction thereof is prohibited.

3. An apparatus as claimed in claim 1, wherein said actuation means comprises a first casing housing said body in such a manner to have a top wall thereof opposing a top surface of said body with a first resilient means disposed therebetween to bias said top wall to a remote position relative to the top surface of said body, which is the rest position of the actuation means, and to allow said first casing to be movable against said resilient means toward a close position relative to said body, which is the work position of the actuation means, and wherein said driving wheel comprises a follower pin extending from a surface opposite to the surface thereof on which said detents are formed, through an arcuated slot formed on said cover in concentricity with said central axis, said follower pin further extending into a driving slot formed on a side surface of said first casing, said driving slot comprising a vertical section and an inclined section with said follower pin received within said inclined section so that when said first casing is moved from the remote position to said close position, said follower pin is caused, under the action of both said arcuated slot of the cover and the inclined section of the driving slot of said first casing to move from a first point to a second point and rotate the driving wheel from the first position to the second position thereof as the feeding wheels remain un-moved, and when said first casing is released to move from the close position back to the remote position, said follower pin moves from the second point to the first point to rotate the driving wheel from the second position to the first position with the feeding wheels rotate in unison therewith due to the detent engagement therebetween to advance the strip along the forward direction.

4. An apparatus as claimed in claim 3, wherein said body comprises a tool hole extending from the top surface thereof to the bottom surface thereof to allow the tool to insert therein to engage the screw located at the ready-to-be-tightened position and wherein said first casing comprises a hole corresponding to said tool hole to receive the tool therein so that when said first casing is in the close position, the tool which is inserted into the hole of said casing and the tool hole of said body engages the screw located at the ready-to-be-tightened position and when the casing is in the remote position, the tool is disengaged from the screw.

5. An apparatus as claimed in claim 4, wherein said actuation means further comprises a second casing housing said first casing and said body in such a manner to have a top wall thereof opposing the top wall of said first casing with a second resilient means disposed therebetween to bias the top wall thereof to an upper position and to allow said second casing to be movable against said second resilient means toward a lower position.

6. An apparatus as claimed in claim 3, wherein said first resilient means comprises a spring.

7. An apparatus as claimed in claim 5, wherein said second resilient means comprises a spring.

* * * * *